United States Patent [19]

Kuwabara et al.

[11] Patent Number: 4,887,961

[45] Date of Patent: Dec. 19, 1989

[54] RADIANT WALL BURNER APPARATUS

[75] Inventors: Kenichi Kuwabara, Yashio; Makoto Miyata, Tokyo, both of Japan

[73] Assignee: Kabushiki Kaisha Kuwabara Seisakusho, Japan

[21] Appl. No.: 167,983

[22] Filed: Mar. 14, 1988

[30] Foreign Application Priority Data

Mar. 26, 1987 [JP] Japan ..... 62-72598

[51] Int. Cl.[4] ..... F23C 5/08

[52] U.S. Cl. ..... 431/177; 431/348; 432/175

[58] Field of Search ..... 431/174, 177, 178, 180, 431/347, 348; 432/175

[56] References Cited

U.S. PATENT DOCUMENTS

| | | | |
|---|---|---|---|
| 1,754,603 | 4/1930 | Brown | 431/348 |
| 2,542,750 | 2/1951 | Butz . | |
| 3,123,127 | 3/1964 | Willott | 431/348 |
| 4,402,666 | 9/1983 | Glomm et al. | 431/177 |

FOREIGN PATENT DOCUMENTS 0053911 6/1982 European Pat. Off. .

0531738 8/1931 Fed. Rep. of Germany .

OTHER PUBLICATIONS

Nissho Iwai, "McGill Burner Handbook", 1985.

*Primary Examiner*—Margaret A. Focarino

*Attorney, Agent, or Firm*—Oliff & Berridge

[57] ABSTRACT

A radiant wall burner which is designed to be mounted on a wall of a radiant-type furnace such as an ethylene decomposing surface has a fuel supply tube defining a fuel supply passage for a fuel which may be a gaseous fuel and provided with a fuel outlet nozzle, and an air supply tube combined with the fuel supply tube so as to provide a double-tube structure such that one of the fuel supply tube and the air supply tube constitutes an inner tube while the other constitutes an outer tube, the air supply tube defining an air supply passage for combustion air separate from the fuel supply passage and having an air outlet which opens towards the core region of the radiant-type furnace. The burner apparatus further has a plate disposed so as to oppose the air outlet of the air supply tube thereby to deflect the flow of combustion air form the air outlet in the radial directions.

7 Claims, 6 Drawing Sheets

RADIANT WALL BURNER APPARATUS

BACKGROUND OF THE INVENTION

The present invention relates to a radiant wall burner apparatus suitable for use in a radiant-type furnace such an an ethylene decomposing furnace. More particularly, the present invention is concerned with a radiant burner apparatus capable of forming flames along surface wall surfaces so as to generate radiant heat which effectively heats an object such as, for example, a group of reaction tubes in an ethylene decomposing furnace.

FIG. 8 schematically shows a conventional radiant-type furnace, e.g., an ethylene decomposing furnace. The furnace has a group of reaction tubes 1 disposed in the center thereof, a main burner provided on the bottom of the furnace so as to heat the reaction tubes, and a multiplicity of radiant wall burners 4. In order to avoid various troubles which may be caused when the reaction tubes 1 are directly contacted by a flame, the radiant wall burners 4 are designed and arranged such that they form a flame along the surface of the furnace wall.

The construction of a typical known radiant wall burner is shown in FIG. 9. This burner 4 has a burner body 6 which extends through the center of the burner block 5 so as to project into the furnace. A gaseous fuel G is supplied to the burner body 6. Before entering the burner body 6, the gaseous fuel is mixed with primary air $A_1$ supplied through a primary air inlet provided on the base end of the burner body 6. The fuel mixed with the primary air is radially sprayed through slits or multi-nozzle 8 which are formed on the outer peripheral surface of the burner body 6. An annular space defined between the inner peripheral surface of the burner block 5 and the outer peripheral surface 6 constitutes a passage 9 for secondary air $A_2$ so that secondary air as additional combustion air is supplied into the furnace.

In operation, the primary air is aspirated by a the difference between the pressure of atmospheric air of the room temperature and the negative pressure which is created by the jet of the gaseous fuel G. The thus aspirated primary air is mixed in the gaseous fuel and the thus formed mixture is jetted from the slit nozzle 8 while inducing the secondary air so that the fuel is burnt to form a flame which spreads along the furnace wall surface 3.

In recent years, it has been attempted to use, as the combustion air for burning the fuel in this type of burner, heated excess air or combustion gas from a gas turbine for the purpose of saving energy. The use of such heated excess air or combustion gas in the radiant wall burner of the type described involves a risk that the gaseous fuel may be burnt explosively during mixing with the air. In order to obviate such a risk, it has been proposed to use burners designed to have independent passages for the gaseous fuel and the air down to the burner nozzle, as shown in FIGS. 10 and 11, so as to prevent pre-mixing of the fuel with air. More specifically, the burner shown in FIG. 10 has a triple-tube type burner body 10 constituted by a central tube defining a central passage 11 for a liquid fuel 0, an intermediate tube defining an inner annular passage for the gaseous fuel G, and an outer tube defining an outer annular passage 13 for the combustion air A. The nozzle is so designed as to cause the air-fuel mixture to suitably swirl so that a flame F is formed to spread along the wall surface 3.

On the other hand, the burner shown in FIG. 11 has a burner body 14 constituted by a fuel gas tube 15 and a combustion air pipe 16 surrounding the fuel gas tube 15. The downstream end of the gas tube 15 is branched into two tubes 15A, 15B which are suitably twisted to make the discharged fuel to swirl. In operation, the gaseous fuel G jetted from the burner nozzle swirls together with the air A and is burnt to form a flame F which spreads along the furnace wall surface 3.

The burners of the type shown in FIGS. 10 and 11 which are designed to prevent pre-mixing of the gaseous fuel with air are effective in preventing the explosive burning of the fuel, but involves a risk that the burning is retarded due to the use of the fuel having a high burning speed with the result that the flame is formed apart from the furnace wall surface so as to directly attack the reaction tubes 1. For instance, when a gaseous fuel having a high burning speed such as hydrogen gas is used as the fuel gas, there is a tendency that the burner forms a flame $F_a$ which rapidly grows towards the reaction tubes so as to directly attack the latter, with the result that the reaction tubes 1 are seriously damaged.

SUMMARY OF THE INVENTION

Accordingly, an object of the present invention is to provide a radiant wall burner apparatus which can eliminate the risk of explosive burning of fuel even when a change is caused in the condition of supply of the fuel or the air.

Another object is to provide a radiant wall burner apparatus which is improved in such a way as to prevent formation of flame which would directly attack the reaction tubes.

To these ends, according to the present invention, there is provided a radiant wall burner apparatus designed to be mounted on a wall of a radiant-type furnace, comprising: a fuel supply tube defining a fuel passage for a fuel which may be a gaseous fuel and provided with a spray nozzle for spraying the fuel, an air supply tube disposed concentrically with the fuel supply tube and defining an air supply passage which is separated from the fuel passage, said air supply passage being provided with an air outlet directed towards the core region of the furnace, and a plate disposed so as to oppose to the air outlet thereby to deflect the flow of the combustion air in the radial direction of said air supply tube. The fuel supply tube may be provided with a header in the peripheral surface of which are formed ports of the spray nozzle. A circumferential groove is formed as required in the portion of the outer peripheral surface of the header in which the spray nozzle ports open. The spray nozzle as well as the air outlet are opened towards the plate so that the fuel together with air is blown against the deflector plate so as to be deflected in the radial directions. The plate may be a flat plate or, alternatively, a conical plate so as to be able to gently and smoothly deflect the air and air from the axial direction of the burner to the radial directions. There is no restriction as to which one of the fuel supply tube and the air supply tube constitutes the outer tube. When the air supply tube is used as the outer tube, however, it is advisable that an air injection nozzle is formed adjacent to the deflector plate and also on the inner side of the fuel header so that the layer of the sprayed fuel is sandwiched between the inner and outer air layers, although the invention does not essentially requires the air injection nozzle provided on the inner side of the fuel header. Conversely, the invention may be carried out such that the air supply tube constitutes the inner tube. In such a case, the air supply tube is made to project from the end of the fuel supply tube such as to face the plate. The described arrangement ensures that the combustion air is radially injected radially through the nozzle defined by the plate so as to spread in the radial directions. This flow of air causes the sprayed fuel to spread in the radial directions so that the flame propagates along the surface of the furnace wall without fail. Thus, the deflector plate effectively prevents the fuel and air from directly attacking the reaction tubes and protects the fuel nozzle from overheating due to the heat in the furnace. Thus, the plate plays a double role: namely, the prevention of formation of undesirable flame and the protection of the fuel nozzle tip from burning down. The burner including the deflector plate itself also is prevented from overheating by virtue of the combustion air which impinges upon the inner surface of the plate.

Thus, in the radiant burner apparatus of the present invention, the fuel and the combustion air are supplied separately from each other down to the end of the burner and the nozzle for injecting the combustion is defined by the plate towards which a passage for the combustion air or a fuel/air mixture opens. In consequence, the combustion air is discharged radially from the nozzle defined by the plate, so that formation of any flame which would directly attack the reaction tubes is prevented. At the same time, the risk for the fuel to be burnt explosively is eliminated to enable excess heated air or combustion gas from a gas turbine, thus contributing to the saving of energy in an associated plant.

The above and other objects, features and advantages of the present invention will be more fully understood from the following description of the preferred embodiments when the same is read in conjunction with the accompanying drawings.

DESCRIPTION OF THE PREFERRED EMBODIMENTS

Preferred embodiments of the radiant wall burner apparatus of the present invention will be described hereinunder.

Figure 1:
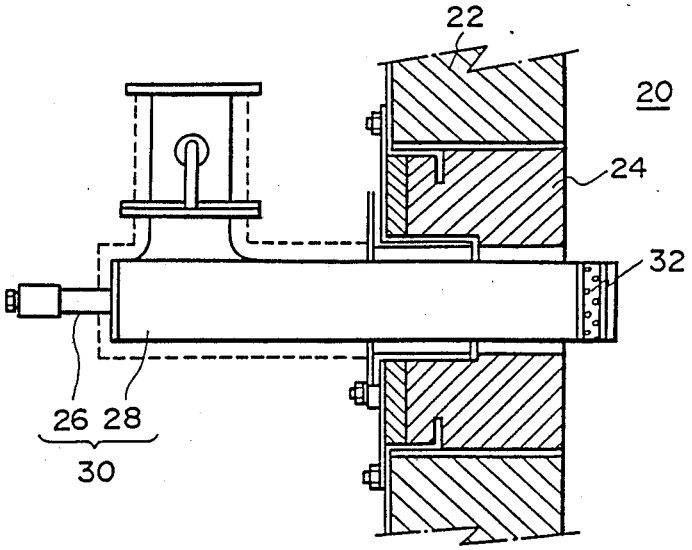
FIG. 1 is a side elevational view of a first embodiment of the radiant wall burner apparatus in accordance with the present invention.
Figure 2:
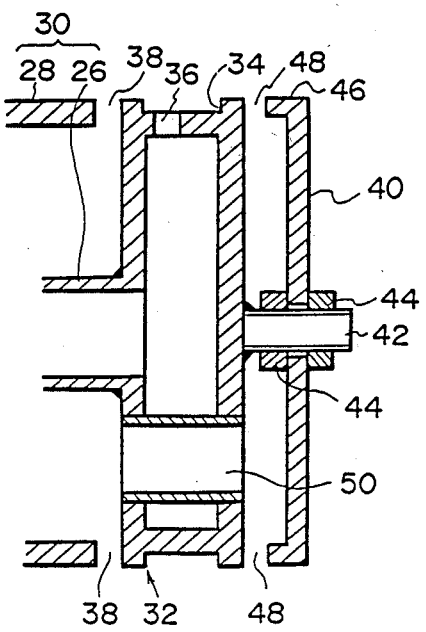
FIG. 2 is an enlarged sectional view of an essential portion of the burner apparatus shown in FIG. 1.
Figure 3:
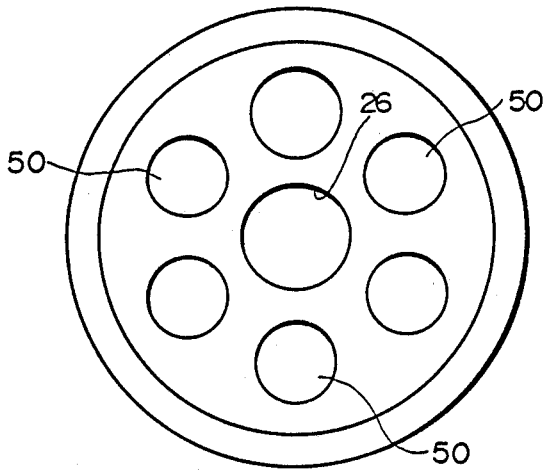
FIG. 3 is a sectional view taken along the line III—III of FIG. 2.

Referring first to FIGS. 1 to 3 which show a first embodiment of the radiant wall burner apparatus of the present invention, the burner apparatus is mounted on a furnace wall 22 of a radiant-type furnace 20 through the intermediary of a burner block 24 which is made of, for example, a refractory brick. Basically, the burner has a double-tube-type construction composed of a pair of tubes arranged such that one of the tubes surround the other. Thus, the burner has a burner body 30 which is constituted by a central fuel supply tube 26 constituting a passage for a fuel and an outer combustion air supply tube 28 defining a passage for combustion air. As will be seen from FIG. 2, the burner body 30 is provided at its distal end, i.e., the end facing the furnace chamber, with a small cylindrical fuel header 32 which is communicated with the fuel supply tube 26 but is spaced from the end of the air supply tube 28 by a predetermined gap. The fuel header has a diameter which is substantially the same as that of the air supply tube 28, and is provided in the outer surface thereof with an annular groove 34. A plurality of nozzle ports are formed in the wall of the fuel header 32 so as to open in the annular groove 34 in a staggered manner so as to constitute a fuel nozzle 36 which radially sprays the fuel supplied through the fuel supply tube 26. The gap between the end of the air supply tube 28 and the fuel header 32 defines an annular opening which constitutes a primary air outlet nozzle 38 capable of discharging the combustion air in the radial directions.

The burner apparatus has a disk-shaped heat shielding plate 40 which is attached to the distal end of the burner body 30 such that a predetermined gap is formed between the plate 40 and the fuel header 32. More specifically, the plate 40 is mounted on the distal end of the fuel header 32 by being carried by a mounting screw 42 which projects from the center of the end surface of the header 32, and is fixed by a pair of fixing nuts 44 screwed to the mounting screw. The outer peripheral edge of the plate 40 is bent back towards the fuel header 32 so as to provide a peripheral wall 46 which has a small height in the axial direction of the burner. An annular gap formed between the axial end of the peripheral wall 46 and the opposing axial end of the fuel header 32 constitutes a secondary air outlet nozzle 48. The arrangement is such that the air supplied through the air supply tube 28 is introduced into the space defined between the deflector plate 40 and the header 32, through air introduction passages 50 which extend through the header 32. As will be understood from FIG. 3, the air introduction passages 50 are constituted by small cylindrical members which are arranged on a common circle and extend through the fuel header 32 so as to face the annular air supply passage defined by the air supply tube 28, whereby the air from the air supply passage is allowed to directly impinge upon the inner surface of the plate 40. The plate 40, which is heated at its side facing the furnace chamber, is effectively cooled by the combustion air introduced through the air introduction passages 50. Thus, the fuel header 32 and the plate 40 in cooperation constitutes an air header having the secondary air outlet nozzle 48 which discharges the combustion air in radial directions. The air discharged from the secondary air outlet nozzle 48 forms an air layer which cooperates with layer of air discharged from the primary air outlet nozzle 38 in sandwiching the fuel therebetween so as to ensure that the fuel is burnt in a good order. The layers of air flowing radially outward also serves to enforce the fuel to flow radially, thereby preventing formation of flame having substantial component spreading in the axial direction of the burner, whereby the flame spreads along the surface of the furnace wall.

Thus, the first embodiment of the radiant wall burner of the invention offers the following advantages.

The burner body 30 is mounted so as to project into the furnace chamber, and a plate 40 is attached to the burner, so that the primary air, secondary air and the fuel are discharged radially from the respective nozzles 38, 48 and 36, thereby ensuring that the flame spreads along the surface of the furnace wall 22. In particular, the heatshielding plate 40 defines the secondary air outlet nozzle 48 which is annular, so that air emanating therefrom is directed radially outwardly so as to prevent the fuel from scattering in the axial direction, i.e., towards the core region of the furnace chamber. The fuel outlet nozzle 36 has nozzle ports which open in the annular groove 34 formed in the outer peripheral surface of the fuel header 32. The primary air and the secondary air which are blown from both sides of the fuel header 32 serve to create a negative pressure zone in and around the annular groove 34 so as to involve the fuel. Thus, the burning is stabilized without substantial scattering of the flame, thereby enhancing the heat radiation effect. The presence of the negative pressure zone promotes the mixing of the fuel and air, thus enhancing the combustion efficiency. The heat-shielding plate 40 is effective in preventing the flame on the burner to spread towards reaction tubes in the core region of the furnace and, in addition, serves as a heat shielding member which protects the nozzle tip of the burner from heat radiated from the core region of the furnace, thereby preventing carbon in the fuel from being freed. The heat shielding effect produced by the plate 40 is maintained effectively because the plate 40 is cooled by the combustion air impinging upon the inner surface thereof.

Although in the described embodiment the primary and secondary air outlet nozzles 38, 40 are annular nozzles, these nozzles may be constituted by a plurality of nozzle ports arranged in rows. It is also to be noted that the provision of the annular groove 34 is not essential and an effective negative pressure zone can be formed even when such a groove is omitted. It is, however, advisable to employ such an annular groove in order to enhance the mixing of the fuel with the combustion air. The nozzle ports of the fuel outlet nozzle 36 may be arranged along a circumferential line, although they are arranged in a staggered manner in the described embodiment.

Figure 4:
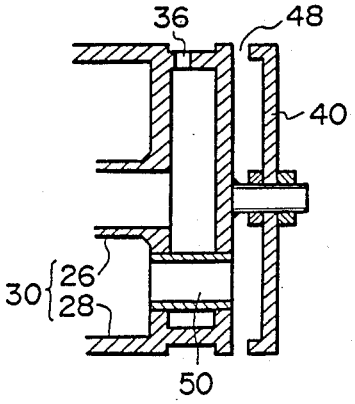
FIG. 4 is a sectional view of an essential portion of a second embodiment of the radiant wall burner apparatus of the present invention.

A second embodiment of the invention will be described with reference to FIG. 4. The second embodiment is different from the first embodiment in that it is devoid of the primary air outlet nozzle 38 used in the first embodiment. Other portions are materially the same as those of the first embodiment.

In this embodiment, the sole air outlet nozzle 48 defined between the heat-shielding plate 40 and the fuel header 32 effectively generates a negative pressure zone on the outer side of the header. The second embodiment, therefore, can produce the same effects as those derived from the first embodiment.

Figure 5:
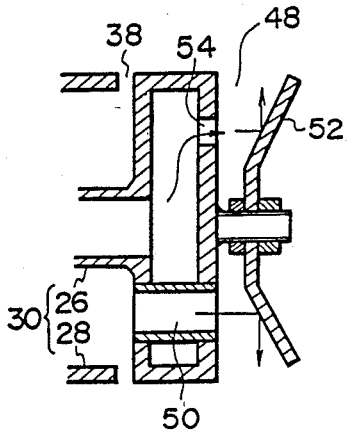
FIG. 5 is a sectional view of an essential portion of a third embodiment of the radiant wall burner apparatus of the present invention.
Figure 6:
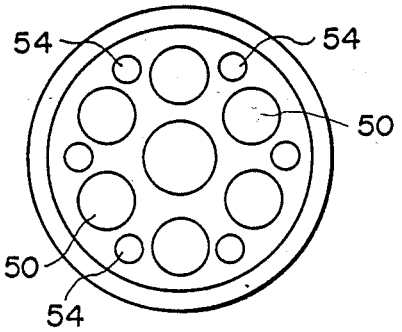
FIG. 6 is a sectional view taken along the line VI—VI of FIG. 5.

FIGS. 5 to 6 show a third embodiment of the radiant wall burner apparatus of the present invention. This embodiment features that the heat-shielding plate is constituted by a conical plate 52 having a conical outer peripheral portion which diverge towards the core region of the furnace chamber. Another features resides in that, as will be clearly seen from FIG. 6, the nozzle ports of the fuel nozzle 54 are arranged to open in the axial end surface of the fuel header 32, at positions between adjacent air introduction passages 50 which penetrate the fuel header 32, unlike the preceding embodiments in which the fuel nozzle ports open in the outer peripheral surface of the fuel header 32. In this embodiment, therefore, the space between the fuel header 32 and the plate 52 constitutes an air-fuel mixture forming zone, and the mixture formed in this zone is deflected on the conical surface of the cone plate 52 so as to spread along the furnace wall. It is therefore possible to form a flame which spreads along the surface of the furnace wall, as in the case of the preceding embodiments.

According to the third embodiment, the space between the end surface of the burner body 30 and the plate 52 constitutes a mixture forming zone. The plate 50 effectively prevents generation of axial component of flame which would directly attack the reaction tubes in the core region of the furnace. At the same time, the fuel outlet nozzle is protected by the plate 50 from the heat, whereby any coking attributable to overheating of the fuel outlet nozzle is avoided.

Figure 7:
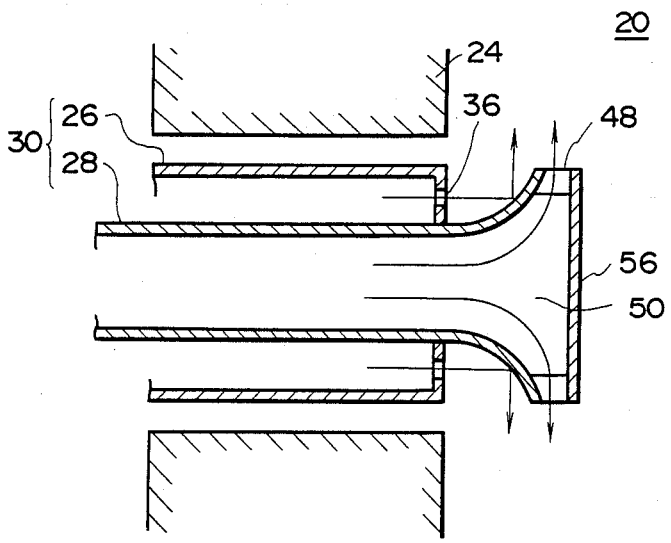
FIG. 7 is a sectional view of an essential portion of a fourth embodiment of the radiant wall burner apparatus of the present invention.
Figure 8:
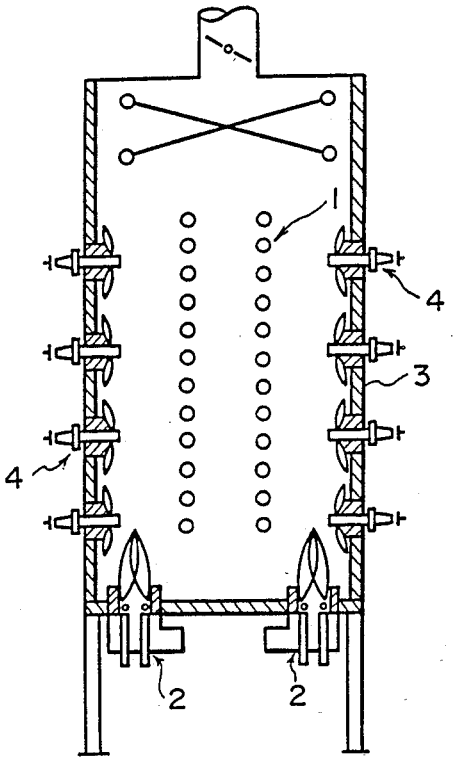
FIG-8 (PRIOR ART)
FIG. 8 is a sectional view of a radiant-type furnace.
Figure 9:
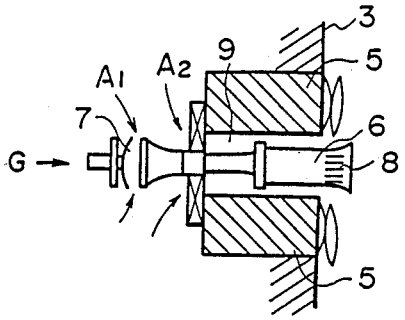
FIG-9 (PRIOR ART)
FIG. 9 is a side elevational view of a known pre-mixing type burner.
Figure 10:
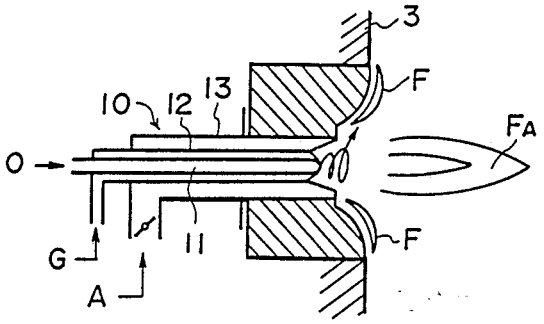
FIG-10 (PRIOR ART)
FIG. 10 is a sectional view of an example of a known burner having separate channels for fuel and air.
Figure 11:
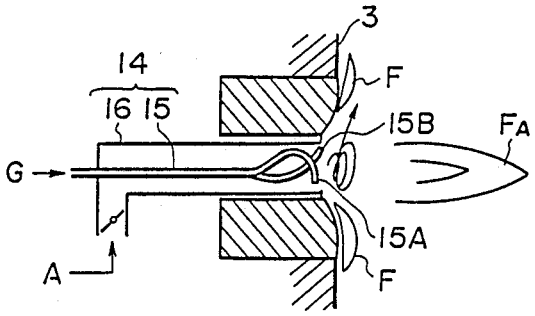
FIG-11 (PRIOR ART)
FIG. 11 is a sectional view of another example of a known burner having separate channels for fuel and air.

A fourth embodiment will be described with reference to FIG. 7. In this embodiment, the air supply tube 28 is disposed inside the fuel supply tube 26 which constitutes the outer tube. In this embodiment, therefore, the end opening of the air supply tube 28 constitutes the air outlet 50. A plate 56 is disposed so as to face the air outlet 50. The end portion of the air supply tube 28 is conically expanded so as to diverge towards the core region of the furnace, and an air outlet nozzle 48 is defined by the brim of the conically shaped end of the air supply pipe 28 and the outer peripheral portion of the plate 50. On the other hand, the fuel outlet nozzle 36 is constituted by nozzle ports which are formed in the axial end surface of the fuel supply tube so as to face the outer surface of the conically shaped end portion of the air supply tube 28, so that the fuel is deflected to flow radially outwardly.

In this embodiment also, the air layer is formed so as to spread radially along the surface of the furnace wall so as to effectively burn the fuel to form a flame which spreads along the surface of the furnace wall.

What is claimed is:

1. A radiant wall burner which is designed to be mounted on a wall of a radiant-type furnace, comprising:

a fuel supply tube defining a fuel supply passage for a fuel which may be a gaseous fuel and provided with a fuel outlet nozzle, said fuel supply tube being provided on its end with a fuel header having an annular groove formed in an outer peripheral surface thereof and a plurality of fuel nozzle ports opening in said annular groove so as to constitute said fuel outlet nozzle;

an air supply tube combined with said fuel supply tube so as to provide a double-tube structure such that one of said fuel supply tube and said air supply tube constitutes an inner tube while the other constitutes an outer tube, said air supply tube defining an air supply passage and having an air outlet which opens towards a core region of said radiant-type furnace; and a plate disposed so as to oppose said air outlet of said air supply tube thereby to deflect the flow of combustion air from said air outlet in the radial directions.

2. A radiant wall burner apparatus according to claim 1, wherein said fuel supply tube constitutes said inner tube and said air supply tube constitutes said outer tube.

3. A radiant wall burner apparatus which is designed to be mounted on a wall of a radiant-type furnace, comprising:

a fuel supply tube defining a fuel supply passage for a fuel which may be a gaseous fuel and provided at its end with a fuel header having a plurality of nozzle ports formed in a peripheral wall thereof so as to constitute a fuel outlet nozzle;

an air supply tube combined with said fuel supply tube so as to provide a double tube structure such that one of said fuel supply tube and said air supply tube constitutes an inner tube while the other constitutes an outer tube, said air supply tube defining an air supply passage for combustion air separate from said fuel supply passage, said air supply tube cooperating with said fuel header to define a primary air outlet nozzle, said air supply tube further having a second air outlet extending through said fuel header and opening in a surface of said fuel header adjacent to a core region of said furnace; and a plate disposed near the surface of said fuel header adjacent to said core region of said furnace leaving a predetermined gap therebetween so as to define a secondary air outlet nozzle through which the combustion air introduced through said second air outlet is discharged radially outwardly so as to flow along the surface of said wall of said furnace, said fuel outlet nozzle being positioned between said primary and secondary air outlet nozzles in a direction toward the core region of said furnace.

4. A radiant wall burner apparatus according to claim 3, wherein said fuel supply tube constitutes said inner tube, said air supply tube constitutes said outer tube, and said air supply tube cooperates with a wall of said fuel header adjacent to said wall of said furnace to define therebetween said primary air outlet nozzle.

5. A radiant wall burner apparatus according to claim 3, wherein said fuel header has an annular groove formed in an outer peripheral surface thereof and said fuel outlet nozzle is provided within said annular groove.

6. A radiant wall burner apparatus which is designed to be mounted on a wall of a radiant-type furnace, comprising:

a fuel supply tube defining a fuel supply passage for a fuel which may be a gaseous fuel and provided at its end with a fuel header having a plurality of nozzle ports formed in a wall thereof adjacent to a core region of said furnace so as to constitute a fuel outlet nozzle;

an air supply tube surrounding said fuel supply tube so as to define therebetween an air supply passage for combustion air separate from said fuel supply passage, said air supply tube cooperating with a wall of said fuel header adjacent to said wall of said furnace to define therebetween a primary air outlet nozzle, said air supply tube further having a second air outlet extending through said fuel header and opening in a surface of said fuel header adjacent to the core region of said furnace; and a plate disposed near the surface of said fuel header adjacent to said core region of said furnace leaving a predetermined gap therebetween so as to define an outlet nozzle through which the combustion air introduced through said second air outlet and said fuel from said fuel outlet nozzle are deflected radially outwardly so as to enable them to flow along the surface of said wall of said furnace.

7. A radiant wall burner apparatus according to claim 6, wherein said plate is a conical plate diverging toward the core region of said furnace.

* * * * *